US005961298A

United States Patent [19]

Bar-Cohen et al.

[11] Patent Number: 5,961,298

[45] Date of Patent: Oct. 5, 1999

[54] TRAVELING WAVE PUMP EMPLOYING ELECTROACTIVE ACTUATORS

[75] Inventors: Yoseph Bar-Cohen, Seal Beach; Benjamin Joffe; Shyh-Shiuh Lih, both of Chatsworth, all of Calif.

[73] Assignee: California Institute of Technology, Pasadena, Calif.

[21] Appl. No.: 08/673,648

[22] Filed: Jun. 25, 1996

[51] Int. Cl.[6] ..... F04B 17/00

[52] U.S. Cl. ..... 417/322; 417/413.2; 417/413.3

[58] Field of Search ..... 417/322, 413.2, 417/413.3

[56] References Cited

U.S. PATENT DOCUMENTS

| | | | |
|---|---|---|---|
| 4,395,719 | 7/1983 | Majewski et al. | 417/322 |
| 5,078,581 | 1/1992 | Blum et al. | 417/413.3 |
| 5,192,197 | 3/1993 | Culp | 417/322 |
| 5,215,446 | 6/1993 | Takahashi et al. | 417/322 |
| 5,224,843 | 7/1993 | van Lintel | 417/322 |

FOREIGN PATENT DOCUMENTS

| | | | |
|---|---|---|---|
| 275285 | 3/1970 | U.S.S.R. | 417/322 |
| 1617210 | 12/1990 | U.S.S.R. | 417/322 |
| 1418274 | 12/1975 | United Kingdom | 417/413.2 |

*Primary Examiner*—Bibhu Mohanty
*Attorney, Agent, or Firm*—Michaelson & Wallace

[57] ABSTRACT

A traveling wave pump which employs one or more pairs of interfacing plates to transfer fluid (gas or liquid) from one or more inlets to one or more outlets. At least one of the plates in each pair of interfacing plates is driven so as to produce a flexure traveling wave therein. Actuators incorporating electroactive elements are used to drive the driven plates and create the flexure traveling wave. This wave causes chambers to form between the interfacing plates which move from one end of the driven plate to the other in the direction of the wave. Fluid is drawn into a forming chamber, and eventually the forming chamber closes trapping the fluid therein. The fluid is then transported through the pump by the now completely formed chamber as it propagates along the plate interface. If only one of the interfacing plates is driven, the other remains fixed in that no chambers are formed at its surface. However, where both plates are driven, the traveling waves therein are synchronized and coincident chambers are formed at the surface of both plates, thereby doubling the amount of fluid pumped. In addition, the flow direction can be changed by controlling the phase of the drive signals.

54 Claims, 5 Drawing Sheets

TRAVELING WAVE PUMP EMPLOYING ELECTROACTIVE ACTUATORS

BACKGROUND

1. Origin of the Invention

The invention described herein was made in the performance of work under a NASA contract, and is subject to the provisions of Public Law 96-517 (35 USC 202) in which the Contractor has elected to retain title.

2. Technical Field

The present invention relates to traveling wave pumps, and in particular to traveling wave pumps employing electroactive actuators to excite flexural traveling waves in a pump core. The induced traveling waves form multiple sealed chambers in the pump core which transport gases or liquids from the pump inlet to the pump outlet.

3. Background Art

Conventional pumps use numerous physically moving parts that are subject to wear, material fatigue and fracture, or jamming. These conditions are often worsened by a mismatch in the thermal expansion characteristics of the various moving parts when the pump is subjected to temperature extremes. As a result, the moving parts of conventional pumps commonly fail leading to leakage and/or disablement of the pump. Thus, the long-term reliability of conventional pumps is a major concern. Additionally, conventional pumps are difficult to miniaturize because of the complexity of the various parts and their interaction.

There is an increasing need for miniaturized pumps which are capable of providing long-term reliability over a wide range of temperatures. For example, the current trend to reduce the size of a spacecraft to meet mission requirements has fueled a need for miniaturized, low mass pump mechanisms with long-term reliability and the capability of operating at cryogenic temperatures. In addition, it is desirable for these pump mechanisms to be less expensive than conventional pumps and capable of lower power consumption. Miniature pumps are used for a wide variety of applications on a spacecraft including the controlled supply of liquid and gas, thermal management, cooling systems and vacuum control devices. One example of a vacuum pump application is in a spacecraft used for planet surface sampling missions where soil, rocks, and other geological materials are collected. The samples are either analyzed remotely or returned to earth. For instance, some remote analysis instruments, such as mass-spectrometers, require the forming of a vacuum in a chamber in which collected samples are placed for analysis. Similarly, samples that are to be stored and returned to earth must often be preserved in a vacuum or an inert atmosphere which would be created by a pump mechanism.

A need for reliable, miniaturized pumps is also recognized by the medical community for many instrument applications. One example is the injection of fluids into the body of a patient at controlled times and dosages.

Thus, it is an object of the present invention to provide a pump device without moving parts to improve operating reliability and to facilitate the miniaturization of the mechanism.

It is another object of the invention to provide a pump whose performance is maintained at low temperatures.

Further, it is an object of the invention to provide a pump having a small number of components that are light weight, inexpensive and have minimal power consumption requirements.

SUMMARY

The invention is embodied in a traveling wave pump which employs one or more pairs of interfacing plates to transfer fluid (gas or liquid) from one or more inlets to one or more outlets. At least one of the plates in each pair of interfacing plates is driven so as to produce a flexure traveling wave therein. This wave causes chambers to form between the interfacing plates which move from one end of the plate to the other in the direction of the wave. Fluid is drawn into a forming chamber, and eventually, the forming chamber closes trapping the fluid therein. The fluid is then transported through the pump by the now completely formed chamber as it propagates along the plate interface. The front and back ends of the chamber press against the interfacing surface of the other plate to seal the fluid in the chamber as it is moved along. This sealing effect eliminates the need for the valves typically required in a conventional pump. The pump will also operate even if only one of the interfacing plates is driven and the other remains fixed. In this case the volume of the chambers will be smaller. However, if both plates are driven, the traveling waves therein need to be synchronized and coincident chambers are formed at the surface of both plates. Thus, the effective chamber volume is doubled and twice as much fluid is moved.

The flexure traveling waves are created in the driven plates by one>>>>>or more actuators disposed on their back surface. These actuators have two drivers, each of which has two or more electroactive elements. One of the drivers in each actuator is fed with a first driver signal, while the other driver is fed with a second driver signal exhibiting an orthogonal phase to the first signal. In addition, each adjacent electroactive element is configured so that when one is caused to expand in thickness by the driver signal, the other contracts. The electroactive elements are preferable either piezoelectric or electrostrictive stack devices so as to maximize the expansion and contraction that can be obtained by low voltage drive signal. Finally, the two drivers are physically separated from one another. The combination of the alternating expansion-contraction patterns of the electroactive elements, the phase difference between the two driver signals, and the physical separation of the drivers, results in the flexure traveling wave being created in the driven plate. It is noted that the aforementioned synchronization of the flexure traveling wave between driven plates is accomplished by synchronizing the driver signals.

The frequency of the driver signal will for the most part determine the size and velocity of the chambers formed at the surface of the driven plate by the flexure traveling wave. Since the size and velocity of the chambers will determine the flow rate of fluid from the pump, it is possible to select a desired flow rate by adjusting the frequency of the driver signal. A preferred way of accomplishing this task is to incorporate a sensor capable of sensing the maximum deflections of the interfacing surface of a driven plate at a particular point. A signal output by the sensor is used by a controller to determine the flow rate being produced by the pump. The aforementioned maximum deflection corresponds to a specific chamber size. In addition, the time between maximum deflections is indicative of the velocity at which the chambers are moving along the interface between the plates. The controller is capable of correlating a chamber size and velocity with a particular flow rate. In addition, the controller can be capable of changing the frequency of the driver signal to change the flow rate. Thus, the controller can be used to achieve and maintain a desired flow rate from the pump.

Some embodiments of the pump are also capable of pumping fluid in the reverse direction (i.e. from the outlet to the inlet). This is accomplished by reversing the direction of the flexure traveling wave in the driven plate. Essentially, reversing the wave direction entails switching the polarity of the driver signal.

The interfacing plates of a traveling wave pump according to the present invention can be shaped in a variety of ways. For example, the plates can be rectangular to form a linear pump, or ring-shaped to form a circular pump. Pumps according to the present invention can also have multiple stages. A multiple stage pump is one with more than one pair of interfacing plates. Each plate pair or stage can have a separate inlet and outlet, or the pump could employ inlet and/or outlet manifolds at each end of the plates, along with a common inlet and/or outlet associated with the manifold (s). These multiple stage pumps can employ shared actuators between adjacent driven plates of adjacent driven plate pairs. However, if this configuration is used, then all the driven plates of the adjacent plate pairs would have to have synchronized traveling waves, and so the same flow rate. If separate actuators are used, the pump would be larger and more costly, but each stage could be driven independently. This has the advantage of allowing the use of a different driver signal frequency for each plate pair to produce a different flow rate from each stage. A pump stage can also be segmented. This is accomplished by dividing the chamber housing into section with the use of partitions. Each section would contain its own plate pair(s) and actuators, as well as its own inlet and outlet.

The above-described traveling wave pump embodiments achieve the previously stated objectives. There are no moving parts. Thus, all the reliability problems associated with wear, material fatigue and fracture, jamming, and mismatches in thermal expansion characteristics that plagued the conventional pump designs are eliminated. In addition, without the necessity for numerous parts, and since the electroactive elements can be made very small, the overall size of a pump in accordance with the present invention can also be small. Thus, miniaturization is readily achieved. This miniaturization and reduction of parts results in a lightweight and inexpensive pump. The electroactive elements are also functional at a wide range of temperatures. This makes the pump suited for operation at cryogenic temperatures. Finally, electroactive elements typically exhibit relatively low power consumption.

In addition to the just described benefits, other objectives and advantages of the present invention will become apparent from the detailed description which follows hereinafter when taken in conjunction with the drawing figures which accompany it.

DESCRIPTION OF THE DRAWINGS

The specific features, aspects, and advantages of the present invention will become better understood with regard to the following description, appended claims, and accompanying drawings where:

DETAILED DESCRIPTION OF THE PREFERRED EMBODIMENTS

In the following description of the preferred embodiments of the present invention, reference is made to the accompanying drawings which form a part hereof, and in which is shown by way of illustration specific embodiments in which the invention may be practiced. It is understood that other embodiments may be utilized and structural changes may be made without departing from the scope of the present invention.

Figure 1:
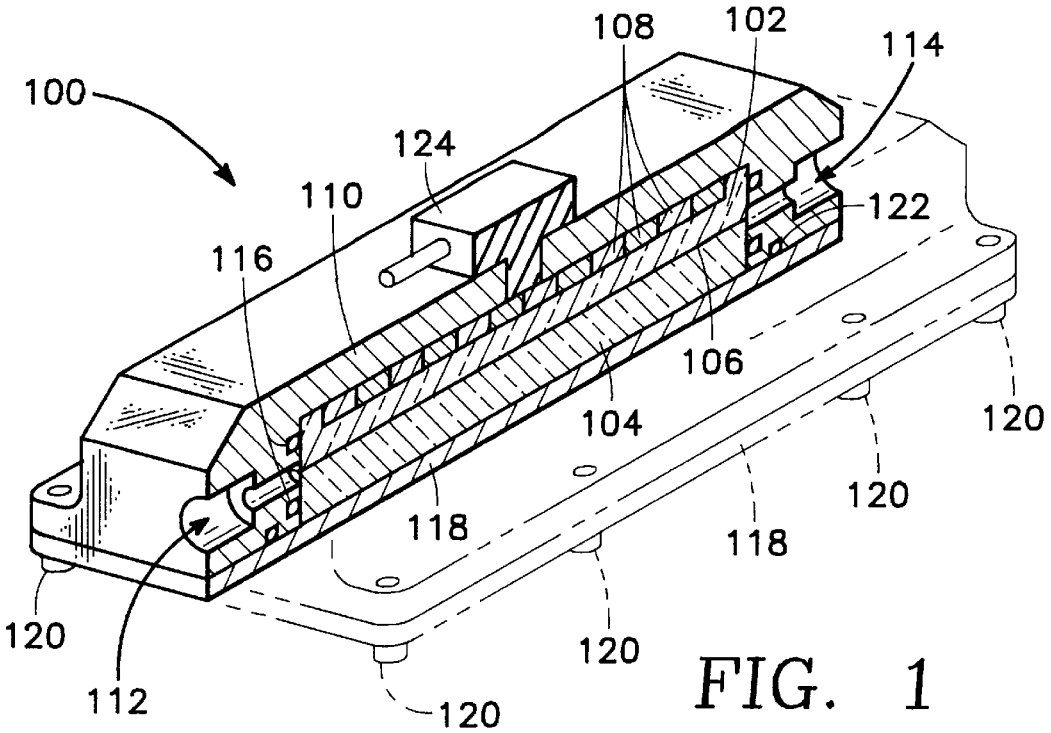
FIG. 1 is a cross-sectional side view of a linear traveling wave pump which employs a single-stage single-driven plate embodiment in accordance with the present invention.

FIG. 1 shows an embodiment of the present invention in the form of a traveling wave linear pump mechanism 100. The pump 100 includes a driven plate 102 which is tightly pressed against a fixed plate 104 to form an interface 106 therebetween. The driven plate 102 is excited by a series of actuators 108 attached to the side of the plate 102 opposite the interface 106, preferably along its entire length. Both plates 102, 104 and the actuators 108 are mounted in a pump housing 110 having an inlet 112 and an outlet 114. Each plate 102, 104 is separately sealed, preferably by a peripheral O-ring 116 located within respective grooves in the housing 110. These seals prevent leakage of the fluid (i.e. gas or liquid) being pumped between the plates 102, 104 from escaping into the upper or lower regions of the housing 110, where it may interfere with the actuators 108 or other pump elements. For ease in assembly, a flange 118 forms the bottom of the pump 100 and is attached to the housing 110 by any appropriate fastening means, such as screws 120. A seal between the housing 110 and the flange 118, such as O-ring 122 located in a groove in the bottom face of the housing, prevents gases or liquids outside of the pump 100 from intruding into the interior chamber of the housing. An electrical connector 124 is attached to the housing 110 to connect the actuators 108 to an external power supply or supplies (not shown). This connector 124 is preferably sealed to prevent intrusion of external fluids into the housing chamber.

Figure 2:
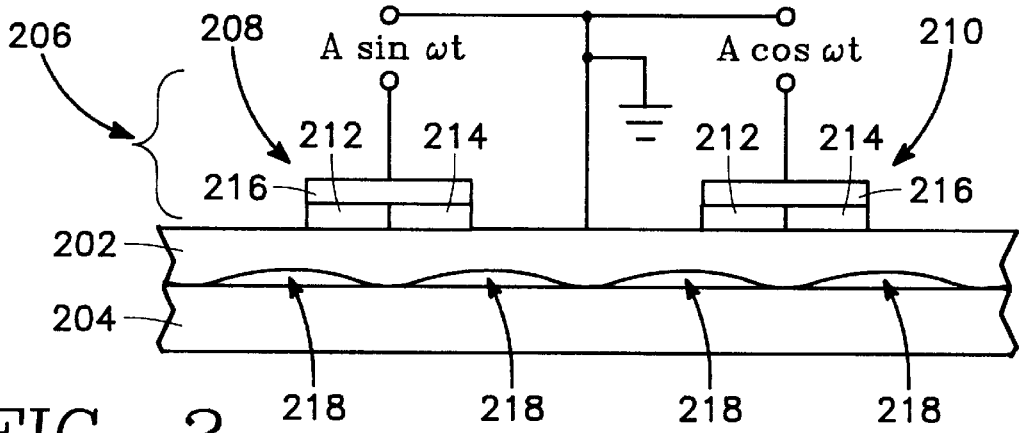
FIG. 2 is a side view illustrating a portion of the interfacing plates and actuators of the pump of FIG. 1.

FIG. 2 provides an illustration of a portion of the driven and fixed plates 202, 204, and a single actuator 206. This figure will be used to show the details of the electrical connections to the power supply(ies) and to described the theory of operation of the pump. As can be seen, an actuator 206 includes a pair of drivers 208, 210, each having two electroactive elements 212, 214 which are attached to the driven plate 202. The left-hand electroactive element 212 of each driver 208, 210 expands in height under the influence of a driver signal at the same time the right-hand electroactive element 214 contracts in height under the same signal, and vice versa. The electroactive elements 212, 214 in each driver 208, 210 are connected together electrically, such as by a bridging electrode 216. The first driver 208 is fed with a first cyclic signal (i.e. Asinωt in FIG. 2), and the second driver 210 is fed with a second cyclic signal having an orthogonal phase to the first (i.e. Acosωt in FIG. 2). In addition, the drivers 208, 210 are provided with a common ground which is connected to the driven plate 202. This scheme causes an identical expansion and contraction sequence in the electroactive elements 212, 214 in each driver 208, 210, except that the sequence is delayed in the right-hand driver 210 due to the 90 degree phase difference between the respective driver signals. The aforementioned signals are generated by one or more power supplies and the appropriate control circuitry (not shown). Preferably, the power supply(ies) and associated circuitry are chosen so as to supply a signal with sufficient power to produce the maximum displacement in the electroactive elements 212, 214.

The pattern of the expansion or contraction of the electroactive elements 212, 214 in each actuator 206, in combination with establishing an appropriate separation distance between the drivers 208, 210, causes a flexure traveling wave in the driven plate 202. The appropriate separation distance between the drivers 208, 210 will vary depending on several factors, including the mechanical properties of the material used to fabricate the driven plate 202 and the response characteristics of the electroactive elements 212, 214. However, it is believed an appropriate separation distance can be readily determined using well known methods once these components have been chosen.

The structure depicted in FIGS. 1 and 2 will create traveling wave which propagates from the inlet side of the pump toward the outlet side (as indicated by the solid line arrow in FIG. 2), thereby pumping fluids from the inlet 112 to the outlet 114 of the pump 100. This propagation direction results from the alternating expansion and contraction sequence in each driver 208, 210, and from connecting the first driver 208 to the +Asinωt signal and the second driver 210 to the +Acosωt signal. However, by switching the input signal such that the first driver 208 is fed with a Acosωt and the second driver 210 is fed with a Asinωt signal, the propagation direction of the flexure traveling wave will be reversed, and so the pumping direction. Thus, by employing the appropriate circuitry to change the polarity of the input signal, the pump 100 becomes reversible.

Referring again to FIG. 2, the flexure traveling wave created in the driven plate 202 causes spaces or chambers 218 to form between the surface of the driven plate 202 and the fixed plate 204 at their interface. A chamber 218 which begins to form at the end of the interface adjacent the inlet side of the pump draws fluid (i.e. gas or liquid) into the forming chamber. As the wave continues to travel down the driven plate 202, this forming chamber 218 will eventually close thereby trapping the fluid drawn into it. The fluid is then pushed down the length of the interface to the outlet side of the pump by what can be characterized as a squeezing motion. It is noted that, once completely formed, the front and back of the chamber 218 are always in contact with the fixed plate 204, therefore, the chamber is sealed. This sealing effect takes the place of the valve mechanisms found in conventional pump mechanisms. It is further noted that when the actuators 206 are not powered, the driven and fixed plates 202, 204 form a seal between the inlet and outlet of the pump. Thus, the pump is inherently self-closing.

FIG. 2 depicts an embodiment of the present invention having two electroactive elements 212, 214 per driver 208, 210. However, this need not be the case. Theoretically, any number of electroactive elements can be employed in each driver 208, 210, as long as the alternating expansion-contraction sequence between adjacent elements is maintained.

The size of the chamber 218 created at between the driven and fixed plates 202, 204 by the flexure traveling wave is dependent on the frequency of the vibration produced in the driven plate 202. The vibration frequency of the driven plate 202 is, in turn, ultimately determined by the frequency of the signal input into the actuators 206. In addition, the velocity at which the chambers 218 move along the interface between the plates 202, 204 is dependent on the vibration frequency of the driven plate 202, and so ultimately the frequency of the input signal. The aforementioned velocity and chamber size determine the fluid flow rate of the pump. In some applications, it is desirable to maximize the fluid flow rate from the pump. In these cases, the actuators 206 would be driven at a signal frequency which creates the particular combination of chamber size and velocity necessary to produce the maximum possible flow rate from the pump. It is believed the signal frequency producing the maximum flow rate will correspond to one that creates a resonance condition in the driven plate 202. A resonance condition is created when a periodic driving force (such as the stimulating force created by the actuators 206) exhibits a frequency which is at or near the natural frequency of the driven plate 202. At the resonant condition, the chambers 218 will be of maximum size. In addition, it is believed that the chamber velocity will be fast enough that, in combination with the maximum chamber size, the flow rate from the pump will be at a maximum. Thus, when a maximum flow rate output from the pump is required, it is preferred that the input signal frequency be such that a resonant condition is created in the driven plate 202. In other applications, it may be desirable to produce a lower flow rate than the maximum the pump is capable of producing. In these cases, the input signal is simply set at a frequency which produces the desired flow rate.

Figure 3:
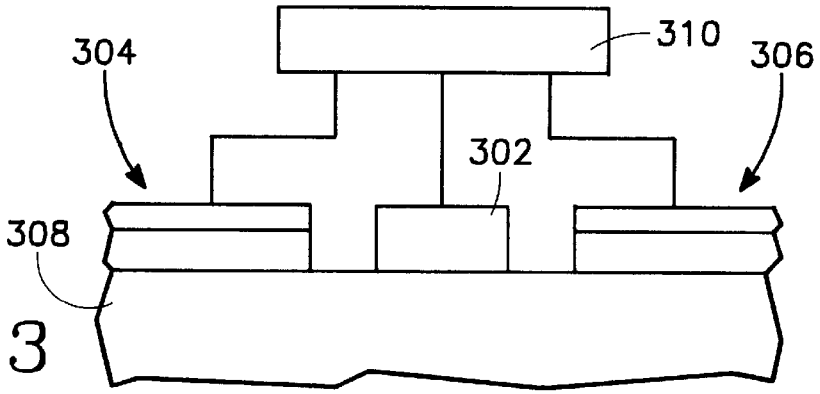
FIG. 3 is a simplified diagram showing a sensor installed on a driven plate of a linear pump embodiment and an associated controller.

A way of controlling the flow rate and ensuring a desired level is achieved and maintained would be to incorporate a sensor 302 between the drivers 304, 306, as shown in FIG. 3. The sensor 302 is of the type which can detect the amplitude of vibrations induced in the driven plate 308 and output a signal indicative of this amplitude. For example, the sensor 302 can be a piezoelectric sensing device such as a PZT-5 sensor available from PiezoSystems of Boston, Mass. The sensor 302 is preferably attached to the driven plate in the space between the drivers 304, 306. The back surface of the driven plate 308 opposite the interface between the driven and fixed plates will vibrate in proportion to the front surface. Accordingly, the sensor 302 will produce a signal indicative of the excursions of the front surface of the plate 308. The signal from the sensor 302 would be monitored to detect its maximum amplitude, which relates to chamber size, and to determine the time between maximums, which relates to the velocity of the chambers. This process would be preferably accomplished using a controller 310, such as a conventional microprocessor, which has been programmed to correlate specific combinations of maximum signal amplitude and time between maxima with the corresponding flow rate from the pump. The controller 310 would also preferably adjust the input signal frequency until a desired flow rate from the pump (maximum or not), such as one input by a user, is achieved. The controller 310 could further be used to maintain the desired flow rate throughout the operation of the pump. Control systems capable of performing the above-described functions are well known in the art. Accordingly, no detailed description will be provided herein.

The accuracy of the sensing process could be improved by including more than one sensor in the pump. For example, signal noise could be reduced by processing the signals from multiple sensors. Redundancy is also achieve since the failure of one sensor would not prevent the controller from operating. As an example, every actuator could include a sensor, if desired. The signals output from the sensors would be processed by the controller, and a signal corrected for noise would be produced for further processing. Here again, control systems capable of performing the above-described function are well known in the art, and so no detailed description need be provided herein.

The electroactive elements are preferably constructed of a stack of thin piezoelectric material layers, each exhibiting a high $d_{31}$ coefficient. For example, piezoceramic crystal based on Navy Code PZT-4d (PbZnTn, i.e. Plumbum, Zirconium, Titanium oxide) would be acceptable layer materials. Piezoelectric stack elements of this type are commercially available from Morgan Matroc, Inc. of Bedford, Ohio. These stack elements will have either a positive or negative poling direction or polarity. An element having a positive (+) polarity will exhibit an increased thickness or height (in comparison to its nominal unenergized thickness) under the portion of the cyclical driving signal having a positive voltage, and a decreased thickness under the portion of the signal having a negative voltage. An element having a negative (−) polarity will behave in the exact opposite manner. Thus, for example in the embodiment depicted in FIG. 2, a piezoelectric stack element having a positive polarity can be employed as the left-hand element 212 of each driver 208, 210, and a piezoelectric stack element having a negative polarity can be employed as the right-hand element 214.

A piezoelectric stack element expands or contacts depending on the strength of the electric field induced in each layer. A stack of thin layers is employed, rather than one thick wafer, because the amount of expansion or contraction is directly related to this electric field strength, which is in turn is directly proportional to the applied voltage and inversely proportional to the thickness of the wafer. Thus, many thin wafers stacked together will provide a greater expansion or contraction for a particular voltage, than a single thicker wafer, due to the greater electric field strength that can be induced in a thinner layer. The use of piezoelectric stack elements also means that a high electric field, and so maximum expansion or contraction (e.g. on the order of 10–20 microns depending on the material used and the number and thickness of the of each layer in the stack element), can be induced using a relatively low voltage and current, for example less than 100 volts and several milliamps. Accordingly, a pump in accordance with the present invention which employs these stack elements will exhibit a very low power consumption in comparison to conventional pumps. Most piezoelectric materials are also active in a temperature range from about 1 to 600 degrees Kelvin, with some degradation of performance at the extremes of this range. However, any degradation in performance can be compensated for by increasing the electric field induced in the material (i.e. by increasing the applied voltage). Given the wide range of temperature that the piezoelectric material can operate at, it makes an excellent choice for the electroactive elements of the present invention.

Although the use of piezoelectric stack elements is preferred, it would also be possible to employ an electrostrictive-type stack element, while still maintaining essentially the same electrical connections and power circuits. These elements are commercially available, such from Matec of Hamptington, Mass. Electrostrictive materials expand under the influence of a positive voltage. However, unlike piezoelectric materials, electrostrictive materials do not contract when subjected to a negative voltage. Thus, the previously described input signal must be modified in order to produce the same pattern of expansion and contraction as was achieved using the piezoelectric stack elements. Specifically, a positive voltage DC offset could be added to the input signal. This offset would cause a "pre-expansion" of the electrostrictive stack elements such that the positive half of the cyclical portion of the driver signal causes further expansion, while the negative half cause a decrease in the "pre-expansion" level. In this way the required alternating expansion and contraction of each driver element is achieved using an electrostrictive stack device. To ensure the amount of expansion equals the amount of contraction (i.e. decrease in "pre-expansion"), it is preferred that the magnitude of the DC offset voltage be at least as large as the voltage drop caused by the negative half of the cyclical portion of the driver signal. Additionally, one element of each driver must expand when the other element contracts, and vice versa. This can be achieved using electrostrictive stack elements by electrically isolating the elements in each driver from one another and inverting the cyclical portion of the signal fed to one of the elements (e.g. the right-hand element 214 of each driver 208, 210 of the embodiment depicted in FIG. 2) to create two separate actuating signals. The cyclical portion of one of the two actuating signals will be the inverse of the cyclical portion of the other signal. In this way, one element will react to an increasing positive voltage of the cyclical portion of the signal fed thereto by expanding further, while at the same time the adjacent element will contract (i.e. undergo a decrease in "pre-expansion") due to the decreasing voltage of the cyclical portion of its actuating signal.

Figure 4:
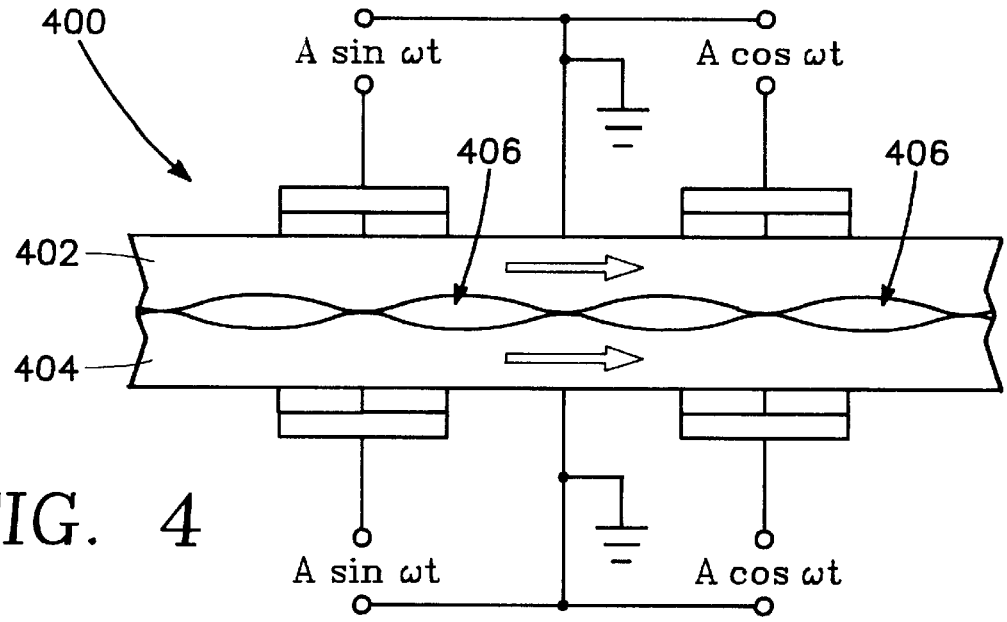
FIG. 4 is a side view illustrating a portion of the interfacing plates and actuators of a pump in accordance with an embodiment of the present invention in which both of the interfacing plates are driven.

FIG. 4 depicts a dual-driven plate embodiment of the present invention where the fixed plate is replaced with a second driven plate 404 and its associated support structures. This second driven plate 404 is identical to the first plate 402 in every way. In addition, the signal input to the second plate 404 is synchronized with the signal input into the first plate 402. In this way, synchronous flexure traveling waves are produced in each plate 402, 404 causing mirror image displacements of their surfaces at the interface between them. As a result, a series of larger chambers 406 is formed having twice the volume as those formed by the pump depicted in FIGS. 1 and 2. These larger chambers 406 in effect double the flow rate of the pump 400. In addition, the contacting surfaces of the two plates 402, 404 at the front and back of each chamber 406 move together in the direction of wave propagation. This synchronous motion eliminates any friction between the surfaces of the plates 402, 404 (such as may exist between the driven plate 202 and fixed plate 204 of the embodiment of FIGS. 1 and 2), thereby further extending the life of the pump 400.

The pump plates, both driven and fixed, can be constructed of various materials depending on the application. Generally, it is preferred that an elastic material exhibiting high degree of resiliency be employed in the construction of the plates. Specifically, it is preferred that the material employed in the construction of the plates be capable of withstanding the stresses and strains they will be subjected to as a result of a flexure traveling wave being induced therein. It is also preferred the chosen material be resistant to fatigue-type failure resulting from long-term use. In this way, the reliability of the pump is enhanced. The specific materials employed will, of course, be dependent on the pump application. For example, metallic plates such as ones made of beryllium-copper or aluminum would exhibit the desired characteristics. However, these materials (and metals in general) may not be appropriate where the fluid being pumped would react in some manner with the plates, thereby either damaging the plates or adversely affecting the fluid. Many plastic or resin-fiber composite materials could be used in these situations. Some glasses may even be appropriate. Alternately, a non-reactive coatings could be employed on the interfacing surfaces of plates made of materials which would otherwise react with the fluid being pumped. Such a coating would preferably possess elastic and resilient qualities similar to those of the plate materials to prevent unwanted cracking, delamination, peeling, and the like. For example, the Kapton 500 series products available from Dupont of Boothwin, Pa. would be an appropriate coating materials.

Figure 5:
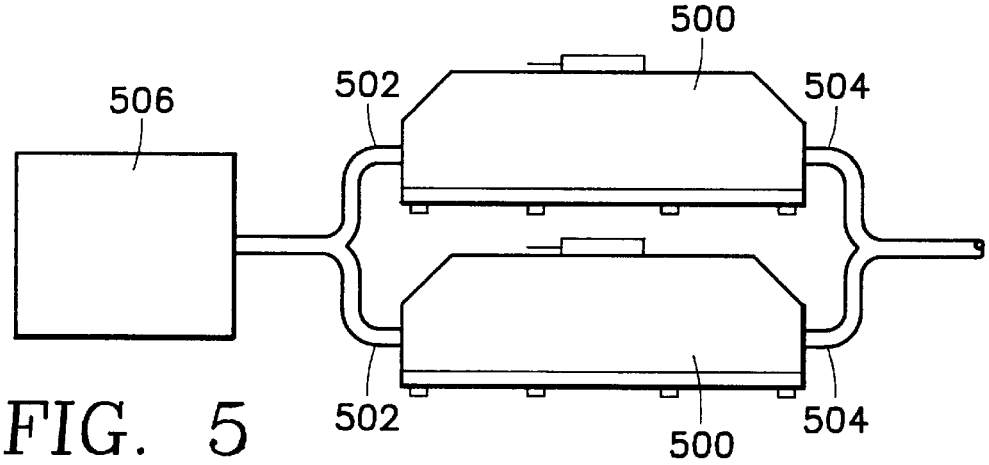
FIGS. 5 and 6 are simplified diagrams depicting inlet and outlet connections for increasing flow rate (FIG. 5) and mixing fluids (FIG. 6).
Figure 6:
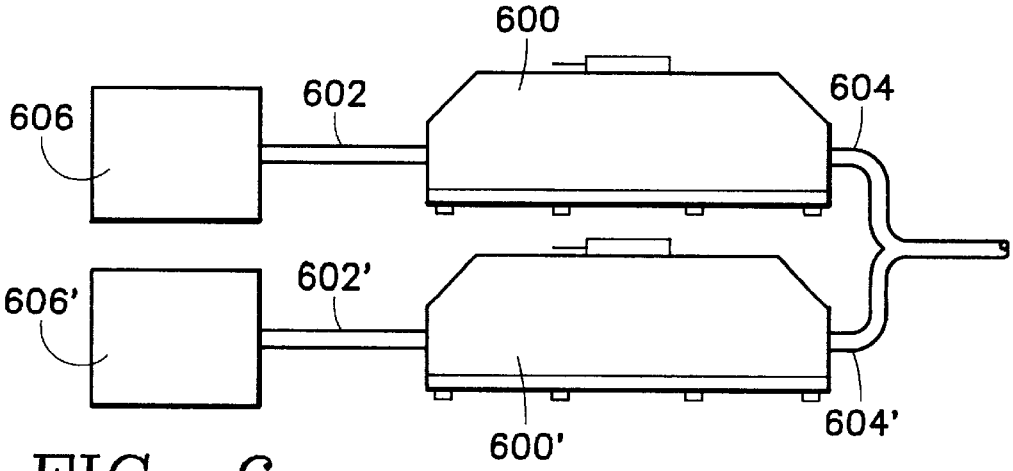

In applications where a greater flow rate is required than a single pump can produce, the outlets 504 of two or more pumps 500 can be tied together, as shown in FIG. 5. Pumps 500 having either single or dual-driven plate configurations can be connected in this way. In this embodiment the inlets 502 of the pumps 500 are connected to one (as shown in FIG. 5) or more reservoirs 506 containing the same type of fluid. This interconnected pump arrangement can also be employed where different fluids from different reservoirs are to be mixed together, as shown in FIG. 6. This mixing is accomplished by connecting the inlet 602 of a first pump 600 to a reservoir 606 containing a first fluid, connecting the input 602' of a second pump 600' to a reservoir 606' containing a second fluid, and finally, tying the outlets 604, 604' of the pumps 600, 600' together. Each pump 600, 600' can also be set at a different driving frequency so that each has a different flow rate. In this way, the amounts of the respective fluids being mixed can be varied as desired. Finally, it is pointed out that although the embodiments of FIGS. 5 and 6 show two interconnected pumps, any number of pumps can be connected together to increase the overall flow rate and/or mix various fluids.

Figure 7:
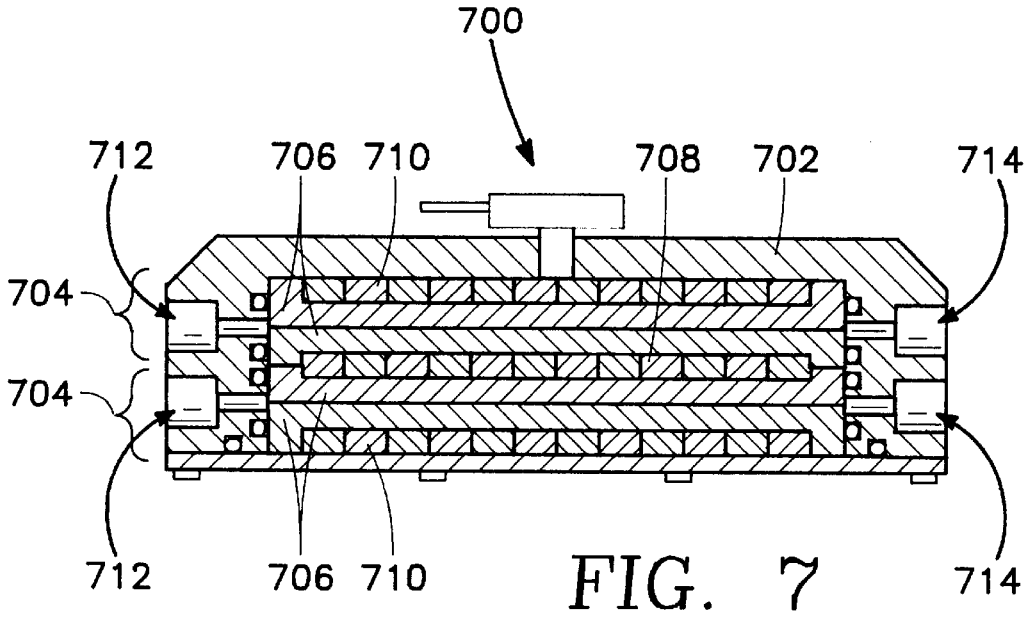
FIG. 7 is a cross-sectional side view of a linear traveling wave pump which employs a two-stage dual-driven plate embodiment with a shared actuator bank in accordance with the present invention.

FIG. 7 depicts an alternate pump configuration which can be used to provide output to more than one external system, increase the overall flow rate of the pump, and/or mix various fluids together. This configuration employs two or more dual-driven plate structures (i.e. pump stages) disposed in a single housing, such as the two stages 704 depicted in FIG. 7. As can be seen, the driven plates 706 of each dual-plate stage 704 that are adjacent to one another (i.e. the two centermost plates 706 of the structures in FIG. 7), are driven by a shared bank of actuators 708 connected to the backside of each plate 706. Thus, when a driver element expands or contracts it provides a stimulus to both of the connected plates simultaneously. By synchronizing the input signal to the shared actuator bank 708, as well as the other banks 710, substantially identical flexure traveling waves are created in each of the driven plates 706. The flow rate from a pump 700 configured in this manner is N times the number of driven-plate pairs (i.e. N=2 in the example of FIG. 7).

The above-described multi-stage pump could be used to supply fluid to more than one external system via its multiple outlets. This task would be accomplished by connecting the inlets 712 to one or more reservoirs (not shown), and connecting the outlets 714 to the individual external systems (not shown). Of course, this same connection scheme could be practiced using separate single-stage pumps. However, a multi-stage pump has advantages over the use of separate pumps because, among other things, the number of actuators needed is reduced and only a single housing is required. The multi-stage pump embodiment illustrated in FIG. 7 could also be employed to increase the flow rate of a fluid over that possible from a single stage pump. An increased flow rate is achieved by connecting the inlets 712 of the pump 700 to the same reservoir, or separate reservoirs containing the same fluid, and tying the outlets 714 together. Further, if two different fluids are to be mixed, each inlet 712 could be respectively connected to separate reservoir containing the different fluids. The outlets 714, in this case would also be tied together. However, it is noted that since identical traveling waves are created in each dual-driven plate structure (thus having substantially identical flow rates), the amount of each fluid mixed at the pump's output would have to be approximately the same in this embodiment.

A compromise pump embodiment in accordance with the present invention can be employed to overcome the problem of having the same flow rate from each pump stage in the multi-stage pump embodiment exemplified in FIG. 7. This compromise embodiment would employ a single housing with multiple inlets and outlets, but would not employ the advantageous shared actuator banks. Instead, each driven plate would have a separate bank of actuators. In this way, the frequency of the input signal can be different between stages, thereby producing different flow rates from the respective stages, and so different quantities of the fluids can be mixed.

It is also possible to use the just-described shared actuator bank concept in a pump combining two or more single-driven plate structures. In such an embodiment, the driven plates of adjoining stages would be placed back to back and connected to opposite sides of the same bank of actuators. The fixed plates would interface with these driven plates on the side opposite the actuator bank. Here again, a single housing would be employed having multiple inputs and outputs.

Figure 8:
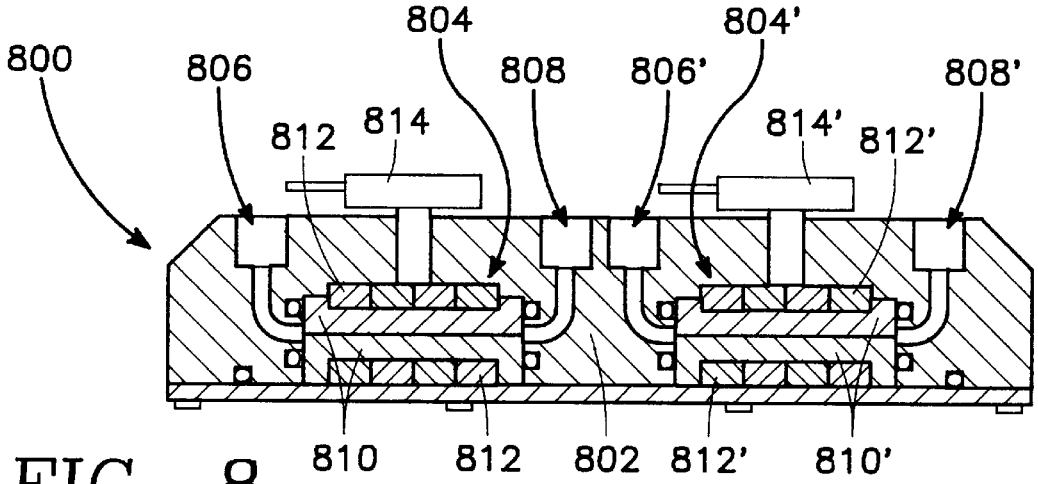
FIG. 8 is a cross-sectional side view of a linear traveling wave pump which employs a segmented structure.

The just-described pump embodiments can be thought of as having multiple pumps within a common housing. This same concept can be embodied in a pump wherein each stage is segmented and provided with a separate inlet and outlet. An example of a single stage pump 800 segmented in this manner is shown in FIG. 8. In this embodiment, the interior chamber of the pump housing is divided into sections by intervening partitions which completely separate one section from another. In the example of FIG. 8 a single partition 802 is used to divide the pump chamber into two separate sections 804, 804'. Each section 804, 804' has its own inlet 806, 806' and outlet 808, 808'. It is noted that although the inlets 806, 806' and outlets 808, 808' shown in FIG. 8 terminate at the top surface of the pump 800, they could be made to terminate at any other surface of the pump as well, such as the bottom or sides. Each section 804, 804' also has its own interfacing driven plates 810, 810' and actuators 812, 812'. The sections 804, 804' can be fed with an identical, synchronized input signal via electrical connectors 814, 814', if the same flow rate from each section is desired. Alternately, each section 804, 804' could be fed with a separate input signal which can vary from section to section. In this way, the flow rate from each section 804, 804' can be different. It is noted that although two separate electrical connectors 814, 814' are shown in FIG. 8, a single combined connector coupled to each actuator could also be employed, if desired.

A segmented pump, such as the one depicted in FIG. 8, could be configured to operate in the same was as the previously-described multi-stage embodiments of the present invention by connecting the inlets and outlets in a similar fashion. Thus, a segmented pump can be used to supply separate external systems, increase the overall flow rate, and/or mix different fluids, just like the multi-stage pump. It is also noted that a pump could embody both a multi-stage and a segmented structure where one or more of the stages is also segmented.

Figure 9:
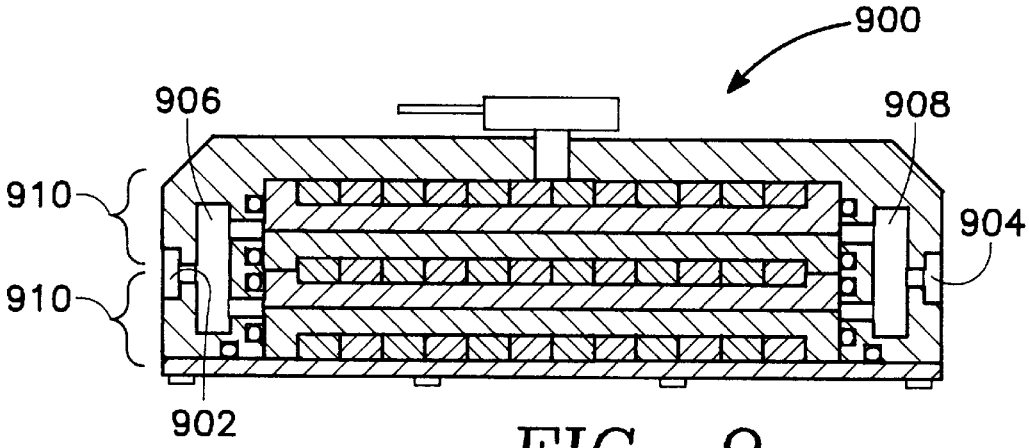
FIG. 9 is a cross-sectional side view of a linear traveling wave pump which employs a two-stage dual-driven plate embodiment in accordance with the present invention having inlet and outlet manifolds.

Another embodiment of a pump in accordance with the present invention which employs multiple stages is shown in FIG. 9. All the previously-described embodiments had an inlet and outlet associated with each stage. However, this need not be the case. FIG. 9 depicts a multi-stage pump 900 intended to increase the flow rate (over a single-stage pump) of a single type of fluid. A single inlet 902 and outlet 904 are employed in combination with respective adjacent inlet and outlet manifolds 906, 908. The fluid enters the pump 900 through the inlet 902 and is distributed throughout the inlet manifold 906. It is then drawn into the plate pairs 910 from the inlet manifold 906. The fluid exits the plate pairs 910 into the outlet manifold 908 and thereafter flows out of the pump 900 through the outlet 904. A variation of this embodiment could be used to mix different fluids during the pumping process. To accomplish the mixing task, the pump could have separate inlets associated with each plate pair and no inlet manifold (i.e. similar to the inlet structure of the embodiments depicted in FIG. 7). This allows the individual inlets to be connected to reservoirs containing different fluids. The different fluids exit their respective plate pairs into an outlet manifold where they mix together. Finally, the now mixed fluids flow out of the pump through the single outlet. A third variation of the pump 900 of FIG. 9 is intended to pump the same fluid to more than one destination. In this version, a single inlet imports a fluid into an inlet manifold. The fluid is then drawn into the plate pairs and pumped to individual outlets at the output end of each plate pair. Thus, the outlet structure of this third variation is similar to that of the embodiment depicted in FIG. 7, and there is no outlet manifold.

Figure 10A:
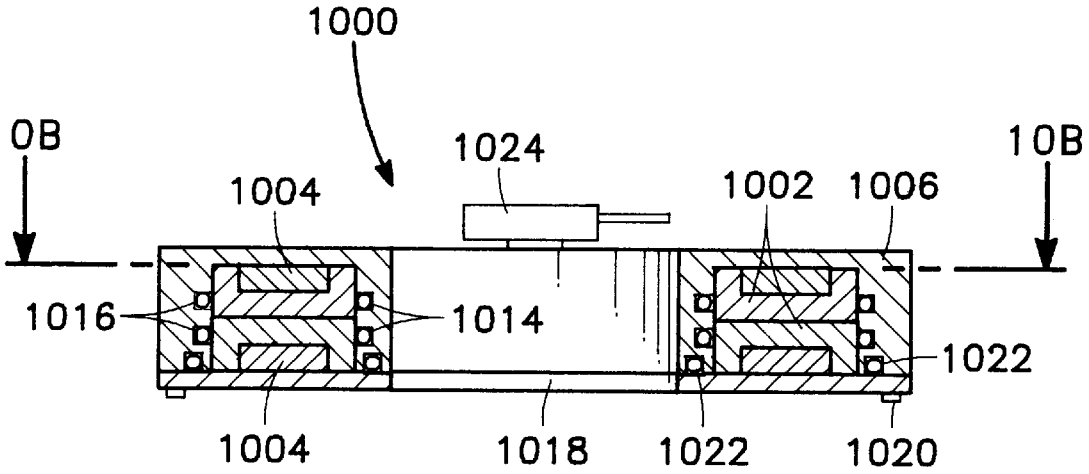
FIG. 10A is a cross-sectional side view of a circular traveling wave pump which employs a single-stage dual-driven plate embodiment in accordance with the present invention.
Figure 10B:
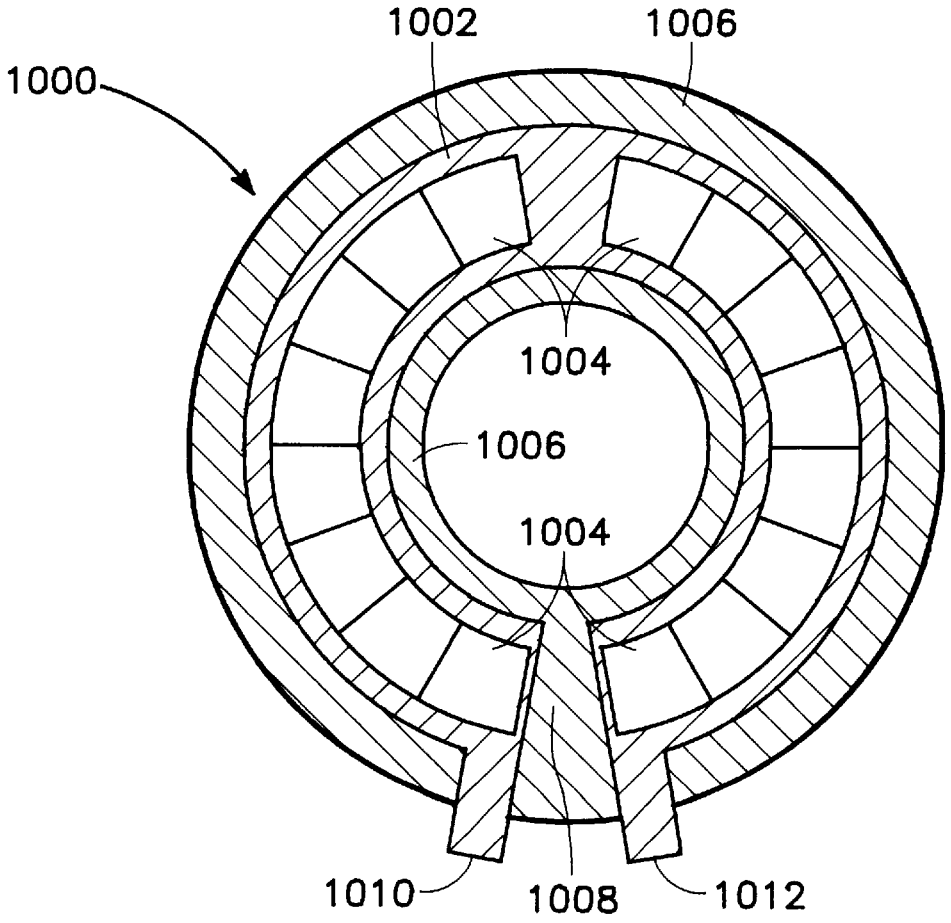
FIG. 10B is a cross-sectional top view of the pump of FIG. 10A.

All the above-described embodiments of a pump in accordance with the present invention have a linear structure. However, other structures are feasible. For example, the pump could employ a circular structure, as in the one-stage dual-driven plate circular pump 1000 depicted in FIGS. 10A–B. This circular pump 1000 includes a pair of driven plates 1002 which are tightly pressed together to form an interface therebetween. The plates 1002 are essentially ring-shaped but have a narrow gap at one point in their circumference. Each driven plate 1002 is excited by an identical actuator 1004 attached to the side of the plate opposite the interface. Both plates 1002 and the actuators 1004 are mounted in an interior cavity of the pump housing 1006. This interior cavity is interrupted by a partition 1008 which preferably has the same general width and shape as the aforementioned narrow gap in the driven plates 1002. There is an inlet 1010 in the housing which opens up into the internal cavity on one side of the partition 1008, and an outlet 1012 which opens up into the cavity on the other side of the partition. The exterior of the pump housing 1006 shown in FIGS. 10A–B is ring-shaped, however, it can be any appropriate shape, for example disk-shaped or square, as long as it contains the aforementioned internal cavity therein to accommodate the driven plates 1002 and actuators 1004.

Each plate 1002 is preferably sealed, such as by an inner and outer O-ring 1014, 1016 located within respective grooves in the housing 1006. For ease in assembly, a flange 1018 forms the bottom of the pump 1000 and is attached to the housing 1006 by any appropriate fastening means, such as screws 1020. Seals, such as O-rings 1022 located in grooves in the bottom face of the housing 1006, form a seal between the housing and the flange 1018. A sealed electrical connector 1024 connects the upper and lower actuators 1004 to an external power supply or supplies (not shown).

Figure 11A:
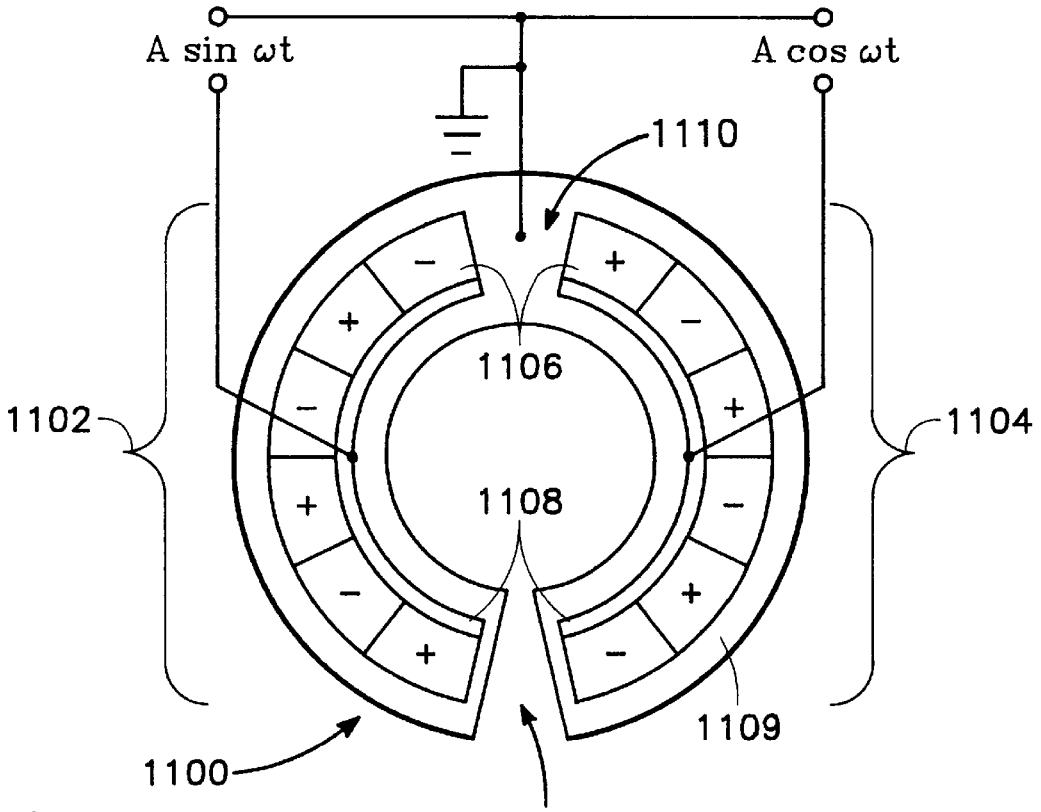
FIG. 11A is an top view depicting one of the interfacing plates and its associated actuator of the pump of FIG. 10A.

FIG. 11A is an more detailed illustration of the actuator employed in the pump (of FIG. 10). As can be seen, the actuator 1100 includes a pair of curved drivers 1102, 1104 each having the same number of arc-shaped electroactive elements 1106 (i.e. piezoelectric or electrostrictive). The electroactive elements 1106 of each driver 1102, 1104 are preferably stack-type elements and have an alternating expansion-contraction pattern. The electroactive elements 1106 in each respective driver 1102, 1104 are connected together electrically, for example, by a bridging electrode 1108 which is in contact with the inside edges of the electroactive elements. The drivers 1102, 1104, when attached to a driven plate 1109 are separated from one another by a space 1110 at one end and by the gap 1112 in the plate at the other end. The space 1110 is larger than the gap 1112 in that it has a longer maximum arc length.

The first driver 1102 is connected to a first cyclic signal (i.e. $A\sin\omega t$ in FIG. 11A), and the second driver 1104 is connected to a second cyclic signal having a phase orthogonal to the first signal (i.e. $A\cos\omega t$ in FIG. 11A). In addition, the drivers 1102, 1104 are provided with a common ground which is also connected to the driven plate 1109. As with the linear embodiments of the present invention, the aforementioned signals are generated by one of more power supplies and the appropriate control circuitry (not shown). The power supply(ies) and associated circuitry are preferably chosen so as to supply a signal which will produce the maximum displacement in the electroactive elements 1106.

Figure 11B:
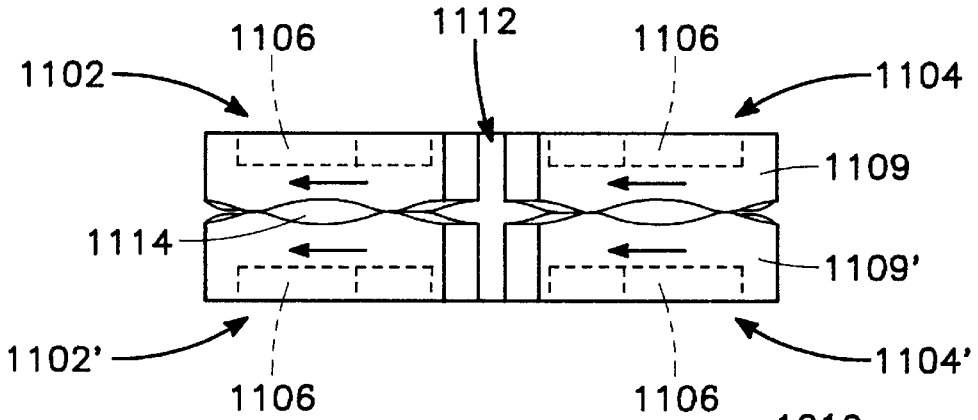
FIG. 11B is a side view depicting the interfacing plates and associated actuators of the pump of FIG. 10A.

As depicted in FIG. 11B, the combination of the aforementioned alternating expansion-contraction pattern of the electroactive elements 1106 in each driver 1102, 1104, 1102', 1104', the asymmetrical pattern caused by the unequal arc lengths of the space (not shown) and gap 1112, and feeding the respective drivers with orthogonal opposed signals, produces a flexure traveling wave propagating in a clockwise direction within the driven plates 1109, 1109'. The traveling wave, in turn, causes the formation of chambers 1114 at the interface between the driven plates 1109, 1109', just as in the linear embodiments. Referring again to FIGS. 10A–B, the inlet 1010 opens up into the interior of the housing 1006 adjacent the interface between the driven plates 1002 such that fluid is drawn into the chambers formed at the interface by the traveling waves. The outlet 1012 similarly opens up in the interior of the housing 1006 adjacent the interface, but on the opposite side of the partition 1008 from the inlet 1010. The partition 1008 blocks the path of the fluid reaching the end of the interfacing plates and forces it out of the outlet 1012.

Essentially, the size and the angular velocity of the chambers created at between the driven plates by the flexure traveling wave is ultimately controlled by the frequency of the signal input into the actuators, just as in the linear embodiments of the present invention. Here again, it is believed that when the actuators are driven at a signal frequency which creates a resonance condition in the driven plates, the chambers formed will be at maximum size. In addition, it is believed that the angular velocity will be great enough to, in combination with the maximum chamber size, ensure the flow rate from the pump will be at a maximum. Thus, when a maximum flow rate output from the pump is required, it is believed that the input signal frequency should be such that a resonant condition is created in the driven plate. Also similar to the linear embodiments, when it is desired to produce a specific flow rate (less than the maximum), the input signal is simply set at a frequency which produces the desired flow rate.

Figure 12:
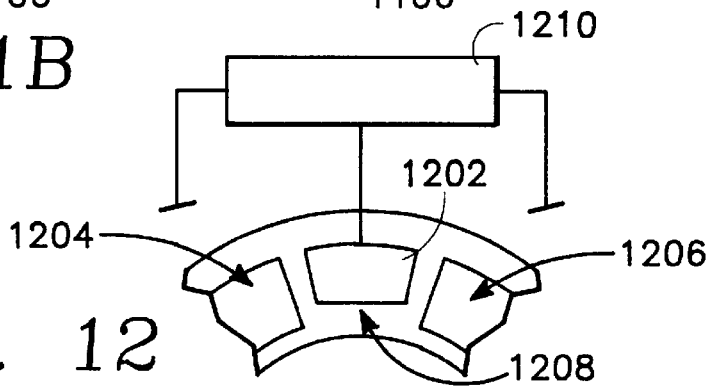
FIG. 12 is a simplified diagram showing a sensor installed on a driven plate of a circular pump embodiment and an associated controller.

The circular embodiments of the present invention also preferably include a sensor similar to the one employed in the linear embodiments to aid in determining chamber size, and so facilitate driving the actuator at a frequency which produces the desired flow rate from the pump. The sensor 1202 is preferably placed between of the drivers 1204, 1206 in the space 1208, as shown in FIG. 12. The sensor 1202 is electrically isolated from both of the adjacent drivers 1204, 1206. A controller 1210, similar to the one described in connection with the linear embodiments of the present invention, is employed to control the signal fed to the actuators, and so the size and angular velocity of the chambers formed at the interfacing surfaces of the driven plates. The controller 1210 uses the signal output by the sensor 1202 to determine the flow rate of the pump (e.g. based on its maximum amplitude corresponding to chamber size and the time between maxima corresponding to the angular velocity of the chambers), and adjusts the signal fed to the actuators as necessary to achieve a desired flow rate. The accuracy of the sensing operation could also be improved by including additional sensors. For example, if a driver were made short enough that a space existed at the end of the driven plate adjacent the gap, a sensor could be installed in this space (not shown). As with the linear embodiments, the signals output from the multiple sensors would be compared by the controller, and a combined signal corrected for noise, etc. would be produced for further processing.

The circular pump illustrated in FIGS. 10A–B employs a single-stage dual-driven plate arrangement. However, other embodiments paralleling the previously-described linear pump embodiments are possible as well. For example, a circular pump employing a multiple stage dual-driven plate arrangement with a shared actuator structure is possible. This embodiment is similar to the linear pump depicted in FIG. 7, except using the circular pump components described above. Circular pump embodiments employing one or more single-driven plate structures are also possible. Additionally, it is noted that the circular pump embodiments according to the present invention can be interconnected to increase the overall flow rate and/or mix fluids, just as the linear embodiment described-previously. Multi-stage circular pumps without shared actuator banks are also possible, as are segmented circular pumps (similar to the linear embodiment of FIG. 8). In a segmented circular pump, the interior chamber of the housing is divided into two or more sections by partitions. Crescent-shaped plate and actuator structures are disposed in each section, and each section has its own inlet and outlet.

While the invention has been described in detail by reference to the preferred embodiment described above, it is understood that variations and modifications thereof may be made without departing from the true spirit and scope of the invention. For example, magnetostrictive-type driver elements could be employed instead of electroactive elements.

Wherefore, what is claimed is:

1. A traveling wave pump comprising:

a pump housing having an internal cavity;

at least one pair of interfacing plates disposed within the internal cavity of the pump;

at least one inlet capable of allowing a fluid to flow into the internal cavity of the pump, each inlet being in correspondence with a first end of a separate one of said pair of interfacing plates;

at least one outlet capable of allowing a fluid to flow out of the internal cavity of the pump, each outlet being in correspondence with a second end of a separate one of said pair of interfacing plates; and actuating means for creating a flexure traveling wave in at least one plate of each pair of interfacing plates whenever said activating means is in an active mode, wherein each plate having a flexure traveling wave created therein is a driven plate and wherein the flexure traveling wave causes fluid carrying chambers to form between the pair of interfacing plates and move along the surface of the interfacing plates in the direction of propagation of the flexure traveling wave.

2. The pump of claim 1, further comprising:

sealing means for preventing fluid flowing into the internal cavity of the pump adjacent the first end of each pair of interfacing plates from leaking outside a region containing the interface between said pair of interfacing plates.

3. The pump of claim 1, wherein the actuating means creates each flexure traveling wave with a propagation direction from the first end of each pair of interfacing plates to the second end thereof.

4. The pump of claim 1, wherein each inlet is further capable of allowing a fluid to flow out the internal cavity of the pump and each outlet is capable of further allowing a fluid to flow into the internal cavity of the pump whenever the actuating means creates each flexure traveling wave with a propagation direction from the second end of each pair of interfacing plates to the first end thereof.

5. The pump of claim 1, wherein the interfacing plates of each pair of interfacing plates are pressed together with a force sufficient to prevent fluid from leaking between any inlet and outlet of the pump whenever said actuating means is in an inactive mode.

6. The pump of claim 1, wherein the actuating means comprises at least one actuator attached to a side of each driven plate opposite its side interfacing with the other plate in the pair of interfacing plates.

7. The pump of claim 6, wherein each actuator comprises a first and a second driver wherein the first driver is physically separated from the second driver, and wherein the first driver is input with a first cyclical driver signal and the second driver is input with a second cyclical driver signal having a phase orthogonal to the first driver signal.

8. The pump of claim 7, wherein each driver comprises at least two electroactive elements, adjacent ones of said electroactive elements being configured such that whenever an electroactive element expands in response to a cyclical driver signal fed to the associated driver, an adjacent electroactive element contracts in response thereto, and whenever the electroactive element contracts in response to a cyclical driver signal fed to the associated driver, the adjacent electroactive element expands in response thereto.

9. The pump of claim 8, wherein the first and second cyclical driver signals input into the first and second drivers periodically produce a maximum possible expansion and a maximum possible contraction of the electroactive elements.

10. The pump of claim 8, wherein the electroactive elements comprise piezoelectric stack devices.

11. The pump of claim 7, wherein:

each driver comprises at least two electrostrictive stack devices;

the respective first and second cyclical driver signals fed to the first and second drivers are divided into two separate actuating signals, one of which is inverted in polarity, and both of which subsequently have a direct current offset imposed thereon to cause a pre-expansion of said electrostrictive stack devices; and adjacent ones of said electrostrictive stack devices are fed with actuating signals having cyclical portions with opposite polarities such that whenever an electrostrictive stack device fed with an actuating signal having the cyclical portion with the non-inverted polarity expands in response thereto, an electrostrictive stack device fed with the actuating signal having the cyclical portion with the inverted polarity contracts in response thereto, and whenever an electrostrictive stack device fed with the actuating signal having the cyclical portion with the non-inverted polarity contracts in response thereto, an electrostrictive stack device fed with the actuating signal having the cyclical portion with the inverted polarity expands in response thereto.

12. The pump of claim 11, wherein the direct current offset is sufficient to cause a pre-expansion of said electrostrictive stack element which exceeds the periodic contraction caused by the cyclical portion of either driver signal.

13. The pump of claim 1, further comprising at least one sensor disposed on each driven plate, said sensor being capable of detecting the magnitude of a displacement of the interfacing surface of an associated driven plate at a predetermined location thereof, and outputting a sensor signal indicative of said magnitude.

14. The pump of claim 13, further comprising a controller capable of using the signal output by each sensor to determine a flow rate of fluid through the pump.

15. The pump of claim 14, wherein the flow rate of fluid through the pump is a function of the frequency of an input signal to the actuation means, and wherein the controller is further capable of changing the frequency of said input signal so as to produce a desired fluid flow rate.

16. The pump of claim 1, wherein each pair of interfacing plates comprises one driven plate and one non-driven fixed plate.

17. The pump of claim 6, wherein each actuator associated with each driven plate is controlled by a substantially identical and synchronized actuator input signal, thereby creating a substantially identical and synchronized flexure traveling wave in each driven plate.

18. The pump of claim 6 wherein at least one pair of interfacing plates comprises a pair of driven plates, and wherein each actuator associated with the individual driven plates of each pair of driven plates is controlled by a substantially identical and synchronized actuator input signal, thereby creating a substantially identical and synchronized flexure traveling wave in each driven plate which causes substantially identical coincident fluid carrying chambers to form at the interfacing surface of each driven plate which move together along said interfacing surfaces in the direction of propagation of the flexure traveling wave.

19. The pump of claim 1 wherein:

more than one pair of interfacing plates is disposed within the internal cavity of the pump; and the actuating means comprises at least one shared actuator disposed between adjacent driven plates of adjacent pairs of interfacing plates.

20. The pump of claim 1 wherein:

each interfacing plate in each pair of interfacing plates has a rectangular shape and abuts the other plate of the pair along its entire length, and wherein said flexure traveling wave propagates longitudinally along the interfacing surface of each driven plate in each pair of interfacing plates.

21. The pump of claim 1 wherein:

each interfacing plate in each pair of interfacing plates has an annular shape except for a narrow gap and abuts the other plate in the pair along its entire circumference with said gap of each plate being in alignment with the other, and wherein said flexure traveling wave propagates in a circular direction along the interfacing surface of each driven plate in each pair of interfacing plates.

22. The pump of claim 21 wherein:

the pump housing comprises an annular internal cavity with a radially oriented partition which completely blocks the cavity at one point in its circumference;

each pair of interfacing plates is oriented within the internal cavity of the pump housing such that the partition is disposed within the gap of each interfacing plate; and each inlet is disposed on one side of the partition and each outlet is disposed on the opposite side of the partition.

23. The pump of claim 22 wherein the width and shape of the partition is substantially the same as that of the gap in each interfacing plate.

24. The pump of claim 1, wherein:

more than one pair of interfacing plates is disposed within the internal cavity of the pump;

each pair of interfacing plates has a separate inlet and outlet; and said outlets are connected together at an output end thereof; and wherein, at least one fluid containing reservoir is connected to the pump, each reservoir being connected to an input end of at least one inlet.

25. The pump of claim 24, wherein:

each reservoir contains a different type of fluid.

26. A segmented traveling wave pump comprising:

a pump housing having an internal cavity divided into sections by intervening partitions;

at least one pair of interfacing plates disposed within each section of the internal cavity of the pump housing;

at least one inlet associated with each cavity section which is capable of allowing a fluid to flow into the internal cavity of the pump, each inlet being in correspondence with a first end of a separate one of said pair of interfacing plates disposed in each cavity section;

at least one outlet associated with each cavity section which is capable of allowing a fluid to flow out of the internal cavity of the pump, each outlet being in correspondence with a second end of a separate one of said pair of interfacing plates disposed in each cavity section; and separate actuating means associated with each cavity section for creating a flexure traveling wave in at least one plate of each pair of interfacing plates therein whenever said activating means is in an active mode, wherein each plate having a flexure traveling wave created therein is a driven plate and wherein fluid carrying chambers form at the surface of each driven plate interfacing with the other plate in the pair of plates and move along said interfacing surface in the direction of propagation of the flexure traveling wave.

27. The pump of claim 26, further comprising at least one sensor disposed on each driven plate wherein each sensor is capable of detecting the magnitude of a displacement of the interfacing surface of an associated driven plate at a predetermined location thereof, and capable of outputting a sensor signal indicative of said magnitude.

28. The pump of claim 27, further comprising a controller capable of using the signal output by each sensor to determine a flow rate of fluid through the pump, and wherein the flow rate of fluid through the pump is a function of the frequency of an input signal to the actuation means and the controller is further capable of changing the frequency of said input signal so as to produce a desired fluid flow rate.

29. The pump of claim 26, wherein each pair of interfacing plates comprises one driven plate and one non-driven fixed plate.

30. The pump of claim 26 wherein the actuating means comprises at least one actuator attached to a side of each driven plate opposite its side interfacing with the other plate in the pair of interfacing plates, and wherein at least one pair of interfacing plates comprises a pair of driven plates, and wherein each actuator associated with the individual driven plates of each pair of driven plates is controlled by a substantially identical and synchronized actuator input signal thereby creating a substantially identical and synchronized flexure traveling wave in each driven plate which causes substantially identical coincident fluid carrying chambers to form at the interfacing surface of each driven plate which move together along said interfacing surfaces in the direction of propagation of the flexure traveling wave.

31. The pump of claim 26 wherein:

each interfacing plate in each pair of interfacing plates has a rectangular shape and abuts the other plate in the pair along its entire length, and wherein said flexure traveling wave propagates longitudinally along the interfacing surface of each driven plate in each pair of interfacing plates.

32. The pump of claim 26 wherein:

each interfacing plate in each pair of interfacing plates has a curved shape and abuts the other plate in the pair along its entire circumference, and wherein said flexure traveling wave propagates in a circular direction along the interfacing surface of each driven plate in each pair of interfacing plates; and the pump housing comprises an annular internal cavity with a radially oriented partitions which completely block the cavity in-between adjacent pairs of interfacing plates.

33. A traveling wave pump comprising:

a pump housing have an internal cavity;

at least one pair of interfacing plates disposed within the internal cavity of the pump;

actuating means for creating a flexure traveling wave in at least one plate of each pair of interfacing plates whenever said activating means is in an active mode, wherein each plate having a flexure traveling wave created therein is a driven plate and wherein the flexure traveling wave causes fluid carrying chambers to form between the pair of interfacing plates and move along the surface of the interfacing plates in the direction of propagation of the flexure traveling wave.

34. The pump of claim 33, further comprising:

at least one inlet capable of allowing a fluid to flow into the internal cavity of the pump, each inlet being in correspondence with a first end of a separate one of said pair of interfacing plates;

an outlet manifold in correspondence with a second end of each pair of interfacing plates; and an outlet connected to the outlet manifold for allowing a fluid to flow out of the pump.

35. The pump of claim 33, further comprising:

an inlet manifold in correspondence with a first end of each pair of interfacing plates;

an inlet capable of allowing a fluid to flow into a manifold; and at least one outlet capable of allowing a fluid to flow out of the internal cavity of the pump, each outlet being in correspondence with a second end of a separate one of said pair of interfacing plates.

36. The pump of claim 33, further comprising:

an inlet manifold in correspondence with a first end of each pair of interfacing plates;

an inlet capable of allowing a fluid to flow into a manifold;

an outlet manifold in correspondence with a second end of each pair of interfacing plates; and an outlet connected to the outlet manifold for allowing a fluid to flow out of the pump.

37. A method for pumping fluids with a traveling wave pump, said method comprising providing a pump housing with an internal cavity, at least one pair of interfacing plates disposed within the internal cavity of the pump, and an actuating device, said method further comprising the step of:

creating a flexure traveling wave in at least one plate of each pair of interfacing plates with said actuating device whenever the actuating device is in an active mode, thereby forming fluid carrying chambers between the pair of interfacing plates, said fluid carrying chambers drawing fluid in and thereafter moving along the surface of the interfacing plates with said fluid trapped therein in the direction of propagation of the flexure traveling wave and ultimately expelling fluid at an end of the interfacing plates.

38. The method of claim 37, wherein the step of creating flexure traveling waves comprises creating each wave with a propagation direction from the first end of each pair of interfacing plates to the second end thereof in a first mode.

39. The method of claim 38, wherein the pump is reversible in that the step of creating flexure traveling waves further comprises creating each wave with a propagation direction from the second end of each pair of interfacing plates to the first end thereof in a second mode.

40. The method of claim 37, wherein each plate having a flexure traveling wave created therein is a driven plate, said method further comprising the steps of:

employing a sensor on each driven plate to detect the magnitude of a displacement of the interfacing surface of the associated driven plate at a predetermined location thereof; and outputting a sensor signal indicative of said magnitude.

41. The method of claim 40, further comprising the step of employing a controller to determine a flow rate of fluid through the pump from the signal output by each sensor.

42. The method of claim 41, wherein the flow rate of fluid through the pump is a function of the frequency of an input signal to the actuating device, the method further comprising the step of employing the controller to change the frequency of said input signal so as to produce a desired fluid flow rate.

43. The method of claim 37, wherein the step of creating a flexure traveling wave in at least one plate of each pair of interfacing plates comprises creating the wave in only one of the plates in at least one pair of interfacing plates.

44. The method of claim 37, wherein a plate with a flexure traveling wave created therein is a driven plate, and wherein the step of creating a flexure traveling wave in at least one plate of each pair of interfacing plates comprises creating a substantially identical and synchronized flexure traveling wave in each driven plate.

45. The method of claim 44 wherein the step of creating a flexure traveling wave in at least one plate of each pair of interfacing plates comprises creating the wave in both plates in at least one pair of interfacing plates thereby causing substantially identical coincident fluid carrying chambers to form at the interfacing surface of each driven plate which move together along said interfacing surfaces in the direction of propagation of the flexure traveling wave.

46. The method of claim 37 wherein more than one pair of interfacing plates is disposed within the internal cavity of the pump, each pair of interfacing plates being sealed to prevent fluid from reaching any other pair of plates, and wherein each pair of interfacing plates has a fluid inlet and outlet exclusively associated therewith.

47. The method of claim 46 further comprising the step of connecting together said fluid outlets associated with said pairs of interfacing plates so as to form a combined output therefrom.

48. The method of claim 47 further comprising the step of connecting said fluid inputs associated with said pairs of interfacing plates to at least one reservoir containing a single type of fluid.

49. The method of claim 47 further comprising the step of connecting each of said fluid inputs associated with said pairs of interfacing plates to a different reservoir containing a different type of fluid.

50. A traveling wave pump, comprising:

a pump housing having an internal cavity;

at least one pair of interfacing plates disposed within the internal cavity, the interfacing plates further comprising:

a driven plate;

a contact plate interfacing the driven plate;

an actuator disposed on the driven plate for creating a flexure traveling wave when the actuator is in an active mode; and fluid carrying chambers at the interface of the driven plate and the contact plate formed by the flexure traveling wave wherein the fluid carrying chambers move along the surface of the interfacing plates in the direction of propagation of the flexure traveling wave.

51. The pump of claim 50, wherein the contact plate is a driven plate.

52. The pump of claim 50, wherein the contact plate is a fixed plate.

53. The pump of claim 50, wherein the fluid carrying chambers are completely sealed.

54. The pump of claim 50, wherein the interfacing plates are pressed together with a force sufficient to form a seal whenever the actuator is in an inactive mode.

* * * * *